US005399022A

United States Patent [19]

Sheets

[11] Patent Number: 5,399,022

[45] Date of Patent: Mar. 21, 1995

[54] VENTING STRUCTURE FOR A MULTIPLE PLY BAG

[75] Inventor: James A. Sheets, Greenwood, S.C.

[73] Assignee: AB Specialty Packaging, Inc., Hialeah, Fla.

[21] Appl. No.: 23,242

[22] Filed: Feb. 25, 1993

[51] Int. Cl.[6] ..... B65D 30/02; B65D 33/01

[52] U.S. Cl. ..... 383/103; 383/109; 383/113

[58] Field of Search ..... 383/100, 101, 103, 45, 383/110, 109, 113; 229/929

[56] References Cited

U.S. PATENT DOCUMENTS

| | | | |
|---|---|---|---|
| 2,593,328 | 4/1952 | Meaker | 229/55 |
| 3,026,656 | 3/1962 | Rumsey, Jr. | 53/22 |
| 3,092,249 | 6/1963 | Chapman | 206/46 |
| 3,302,859 | 2/1967 | Perry | 229/53 |
| 3,370,780 | 2/1968 | Shaw | 229/62.5 |
| 3,394,871 | 7/1968 | Williams et al. | 229/62.5 |
| 3,432,087 | 3/1969 | Costello | 383/103 |
| 3,439,869 | 4/1969 | Shrum et al. | 229/62 |
| 3,494,457 | 2/1970 | Titchenal | 383/101 X |
| 3,610,516 | 10/1971 | Esty | 383/103 X |
| 4,057,144 | 11/1977 | Schuster | 206/439 |
| 4,206,870 | 6/1980 | DeVries | 383/103 |
| 4,404,241 | 9/1983 | Mueller et al. | 383/103 |
| 4,470,153 | 9/1984 | Kenan | 383/100 |
| 4,550,441 | 10/1985 | Keppel | 383/103 |
| 4,550,546 | 11/1985 | Raley et al. | 383/103 X |
| 4,874,630 | 10/1989 | Mendenhall et al. | 383/103 X |

FOREIGN PATENT DOCUMENTS

| | | | |
|---|---|---|---|
| 961222 | 6/1964 | United Kingdom . | |
| 1016476 | 1/1966 | United Kingdom . | |
| 2237553 | 5/1991 | United Kingdom | 393/103 |

*Primary Examiner*—Sue A. Weaver
*Attorney, Agent, or Firm*—Dick and Harris

[57] ABSTRACT

A vented container apparatus for storing various vapor and gas exuding articles formed from two or more plies of sheet material operably adhered together. A venting corridor is formed between at least two of the plies by a void flanked by the sheet adhering medium. A first hole connects the venting corridor to the interior of the container proximate to one end of the container and a second hole distally spaced from the first hole connects the venting corridor to the exterior of the container, proximate to the other end of container.

12 Claims, 2 Drawing Sheets

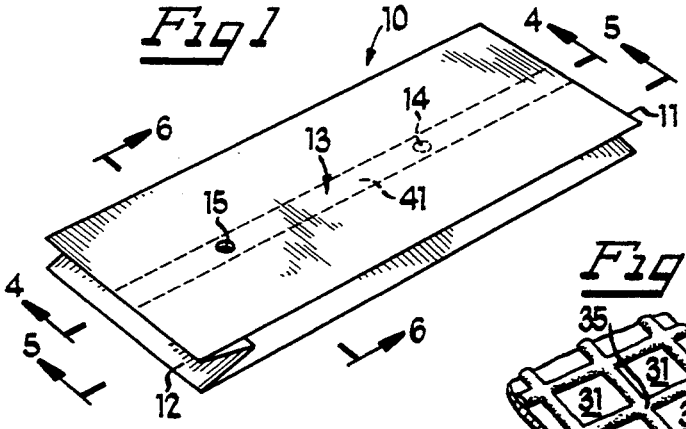
Fig 1
10
4
5
6
11
12
13
14
15
41
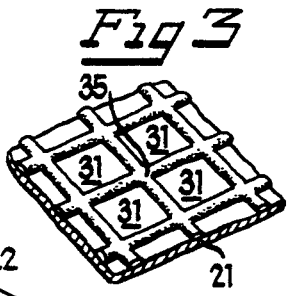
Fig 3
35
31
21
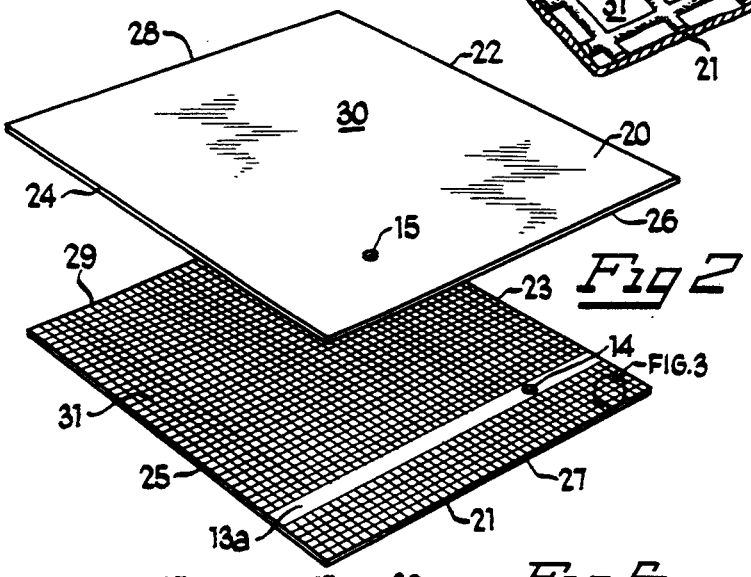
Fig 2
28
22
30
20
24
26
15
29
23
14
FIG.3
31
25
27
21
13a
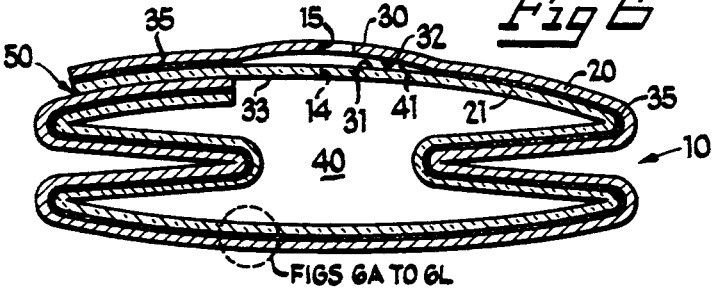
Fig 6
35
15
30
32
50
20
33
14
31
41
21
35
10
40
FIGS 6A TO 6L
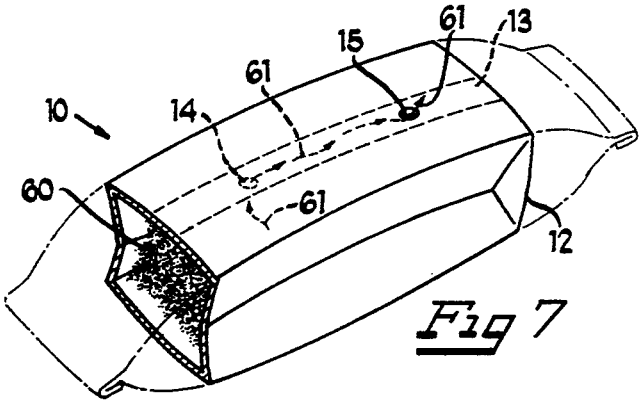
Fig 7
10
14
15
61
13
60
12
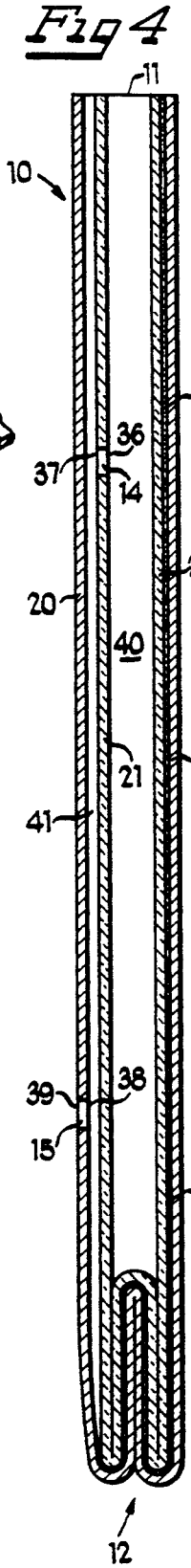
Fig 4
11
10
35
36
37
14
21
20
40
41
39
38
15
12
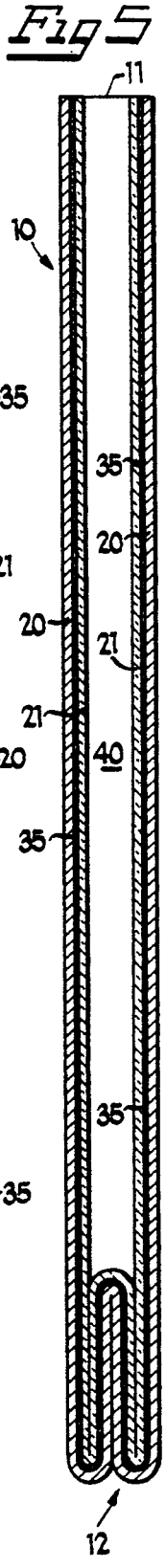
Fig 5
11
10
35
20
21
40
12

VENTING STRUCTURE FOR A MULTIPLE PLY BAG

BACKGROUND OF THE INVENTION

The present invention relates in general to containers and, in particular, to a vented container apparatus for storing various vapor and gas exuding articles.

The water and air impervious storage of various vapor and gas exuding articles, has a number of packaging problems associated therewith. Furthermore, the storage of foodstuffs places further requirements on the packaging. The container must prevent the contamination of such foodstuffs while offgasing vapor and gas which may form after sealing of the container. Creation and continuous expansion of vapors and gases after the sealing of such containers may cause the container to rupture. Even where containers remain undamaged, the expansion of these vapors and gases may deform the package in such a way as to make it more difficult to ship or sell.

There are currently a number of approaches to offgasing the vapor and gas from a container, while substantially preventing the contamination of the articles therein. One approach utilizes a one-way flow mechanical valve adhered to a portion of the container, such that gases and vapors may be vented from the interior of the container to the exterior without exterior contaminates being allowed into the container through the valve. The addition of a mechanical valve adds substantial additional material costs, as well as additional manufacturing steps into the fabrication of the container, which is undesirable.

Yet another approach involves the use of a vent constructed as part of the bag. There are a number of constructions utilizing this approach. One such construction involves perforating a portion of the container to allow vapor and gas to escape. This construction may, however, also allow the articles in the container to become contaminated. Another construction involves intermittent heat sealing an edge of a container, such that an air pervious seal is formed. This approach is further complicated, so as to prevent contamination of the articles, by providing a second intermittently heat sealed line adjacent the first such that their respective gaps are staggered relative to each other, thus, minimizing contamination and migration, although not preventing it. Yet another construction for container venting involves introducing a filter type material to an opening of a container before sealing, such that after sealing, the interior of the container may communicate with the exterior through the filter. These vent constructions involve the introduction of additional materials and/or additional manufacturing steps, thus increasing the material cost of the container while increasing the manufacturing complexity of producing such containers.

Still another approach to venting containers is to provide a channel connecting the interior of the container to the exterior of the container through a passage which is long relative to the size of the container, such that vapors and gases may be released from the interior to the exterior, while substantially preventing the contamination and migration of the articles located within the container. One particular construction of such a channel, as disclosed in U.S. Pat. No. 4,550,441, is accomplished between overlapping portions of the same sheet of material to form a seam region glued at two longitudinal lines forming a channel between the overlapping edge portions and gluelines within the seam, having a hole communicating with the interior region and a hole communicating with the exterior of the bag. This approach to creating a channel involves relatively manufacturing intensive procedures for insuring that the overlapping margins of the sheet are appropriately aligned and appropriately adhered to form the vented container together with additional adhesive.

It is thus an object of the present invention to provide a venting means to conduct vapors and gases exuding from articles contained within a sealed container from the interior of the container to the exterior of the container, while substantially preventing the contamination and migration of the articles located within the container.

It is an associated object of the present invention to manufacture such a vented container apparatus wherein the venting corridor is formed in a less manufacturing intensive, less expensive manner—while still being effective to successfully accommodate the venting, non-contamination and non-migration objectives.

These and other objects of the present invention will become apparent in light of the present specification, claims and drawings.

SUMMARY OF THE INVENTION

The present invention comprises a vented container apparatus for storing various vapor and gas exuding articles formed from a plurality of plies of sheet material configured to create a venting corridor therebetween. The vented container apparatus is comprised of two or more plies of sheet material, such as paper, plastic or foil, each of the two or more plies having a first side, a second side opposite the first side, a top edge, and a bottom edge opposite the top edge.

The vented container apparatus also includes sheet attachment means for operably adhering at least portions of one of the two or more plies to at least another of the two or more plies, such that a portion of the first side of the at least one of the two or more plies is operably adhered to the second side of the at least another of the two or more plies at a ply attachment region by the sheet attachment means. Preferably, the sheet attachment means comprises adhesive or heat activated sealing means.

The two or more plies are configured into a substantially tube shaped, folded container body. The container body has an outermost and an innermost ply of sheet material respectively formed by respective ones of the two or more plies.

In the preferred embodiment., the invention comprises a substantially rectangularly shaped, flat bag, wherein each of the two or more plies of sheet material have a first edge and a second edge opposite their first edge, each of their top and bottom edges being operably disposed between their first and second edges. In this preferred embodiment, the substantially tube shaped, folded container body can be configured as a gussetted bag. Further, the two or more plies may be sealable at their top and bottom edges through plain pinch closures, folded pinched closures, or any other type closure known in the art—to contain articles within the interior region formed between the top and bottom edges.

The vented container apparatus further includes venting means through which the exuded vapor and gas trapped within the interior region of the vented container apparatus is conducted to the exterior of the vented container apparatus. The venting means includes a venting corridor means for transferring the exuded vapor and gas between at least two of the plies of sheet material, which are operably positioned at the ply attachment region, so as to form a void flanked by the sheet attachment means; the void being bounded on its top by the first side of the at least one of the two or more plies, and on its bottom by the second side of at the least another of the two or more plies.

The venting means further includes first hole means for communicating the exuded vapor and gas into the venting corridor means and away from the interior region. The first hole means has at least a first and a second opening, the first opening being operably located within the innermost ply at a position substantially proximate the top of the interior region, and the second opening being operably connected to the venting corridor means.

The venting means further includes second hole means for communicating the exuded vapor and gas out from the venting corridor means and toward the exterior of the vented container apparatus. The second hole means has at least a third and a fourth opening. The third opening is operably connected to the venting corridor means and located at a position substantially proximate the bottom of the vented container so as to be distally spaced from the second opening of the first hole means. The fourth opening is operably located within the outermost ply at the exterior of the vented bag apparatus.

The venting means serves to conduct the exuded vapor and gas from the venting corridor means and in turn from the interior region, for release to the exterior of the container apparatus, while substantially preventing the contamination and migration of the articles located within the internal region.

In the preferred embodiment of the invention, the invention comprises a substantially rectangular shaped bag having a longitudinal axis extending from its top edge to its bottom edge, with the venting corridor means comprising a substantially rectangular shaped corridor operably disposed along this longitudinal axis. The first hole means comprises a first hole operably positioned between the interior region and the substantially rectangular shaped corridor, and the second hole means comprises a second hole operably positioned between the shaped corridor and the exterior of the substantially rectangular shaped bag. Each of said two or more plies of sheet material therewithin have a first edge a second edge opposite said first edge, with each of said top and bottom edges being operably disposed between the first and second edges. In this embodiment, the innermost ply comprises a substantially air and water impervious material, with the outermost ply comprising a substantially porous sheet material, such as paper.

BRIEF DESCRIPTION OF THE DRAWINGS

FIG. 1 of the drawings is a perspective view of the preferred embodiment of Applicant's present vented container apparatus showing, in particular, a gussetted bag having a longitudinal venting corridor with a first hole between the interior of the bag and the venting corridor and second hole extending between the venting corridor and the exterior of the bag;

FIG. 2 of the drawings is an exploded perspective view of Applicant's present vented container apparatus showing, in particular, two plies of sheet material, sheet attachment means positioned on the lower ply of sheet material, a longitudinal void in the sheet attachment means, a first hole through the lower ply of sheet material, and a distally placed second hole through the upper ply of sheet material;

FIG. 3 of the drawings is an enlarged scale view of a region shown in FIG. 2 of the drawings, showing, in particular, the pattern of deployed sheet attachment means utilized in the preferred embodiment of Applicant's invention;

FIG. 4 of the drawings is a side-elevational, cross-sectional view of Applicant's invention shown in FIG. 1, taken along lines 4—4 and looking in the direction of the arrows, showing, in particular, a venting corridor located between the two plies of the container;

FIG. 5 of the drawings is a side-elevational, cross-sectional view of Applicant's invention shown in FIG. 1, taken along lines 5—5 and looking in the direction of the arrows, showing, in particular, sheet attachment means deployed between the two plies of Applicant's container;

FIG. 6 of the drawings is a bottom plan, cross-sectional view of Applicant's invention shown in FIG. 1, taken along lines 6—6 and looking in the direction of the arrows, showing, in particular, the construction of Applicant's present invention;

FIG. 7 of the drawings is a cut-away perspective view of Applicant's present invention showing, in particular, the communication of vapors and gases exuded by the articles contained within the container, through the venting means to the exterior of the present apparatus.

DETAILED DESCRIPTION OF THE DRAWINGS

Figure 6A:
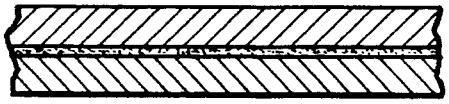
FIGS. 6A through 6L of the drawings are enlarged elevated views of the plies of sheet material shown in FIG. 6 of the drawings, showing, in particular, various materials that may be utilized in practicing Applicant's invention.
Figure 6B:
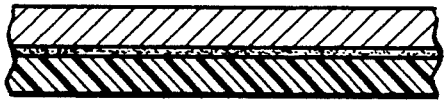
Figure 6C:
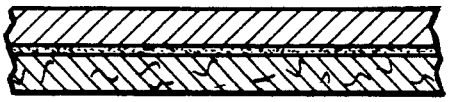
Figure 6D:
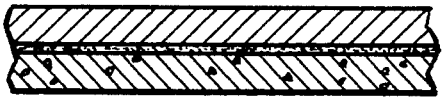
Figure 6E:
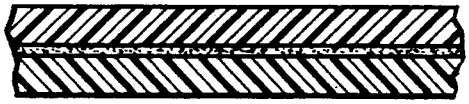
Figure 6F:
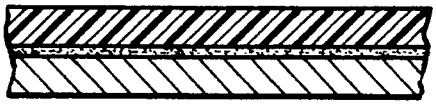
Figure 6G:
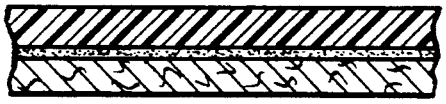
Figure 6H:
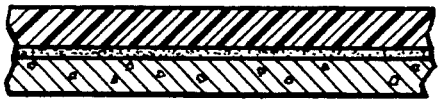
Figure 6I:
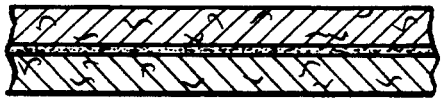
Figure 6J:
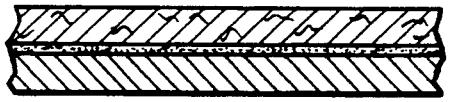
Figure 6K:
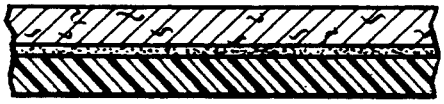

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

Referring to FIG. 1, there is shown a preferred embodiment of Applicant's present vented container apparatus 10. In this embodiment, vented container apparatus 10 is constructed as a gussetted bag having top 11, bottom 12, venting corridor means, void region **13*a* having first hole means 14, second hole means 15 and venting corridor means 41. While bottom 12 is shown in this embodiment as a folded bottom bag, bottom 12 may comprise any bottom type, such as a flat bottom, without departing from the scope of Applicant's invention. As :shown in FIGS. 4, 5, 6, and 7, once vented container apparatus 10 is sealed it has formed therewithin interior region 40 for storing various vapor and gas exuding articles 60**, such as ground coffee or coffee beans.

The preferred embodiment of vented container apparatus 10 shown in FIG. 2, is constructed of two plies of sheet material, more specifically, first ply 20 and second ply 21. While only two plies are shown in this embodiment, further plies of sheet material may be added to vented container apparatus 10 without departing from the scope of Applicant's invention. First ply 20 has a first (lower) side 32 (as shown in FIG. 6), as well as second (upper) side 30, top edge 22, bottom edge 24, first edge 26, second edge 28 and second hole means 15 penetrating therethrough. Second ply 21 has a first (lower) side 33 (as shown in FIG. 6), second (upper) side 31, top edge 23, bottom edge 25, first edge 27, second edge 29 and first hole means 14 penetrating therethrough. In constructing vented container apparatus 10, at least a portion of at least one of the two or more plies is operably adhered to at least another of the two or more plies, by sheet attachment means 35.

In the depicted embodiment, for instance, first side 32 of first ply 20 is operably adhered to second side 31 of second ply 21 by sheet attachment means 35. While sheet attachment means 35 may comprise any number of adhesive materials or techniques, including application of a uniform layer of adhesive material or heat sealing between or among the various plies, in the preferred embodiment, as shown in FIG. 2 and the enlargement of FIG. 3, sheet attachment means 35 comprises an adhesive material applied in a "lattice" pattern over the majority of second side 31 of second ply 21. The particular pattern of FIG. 3 serves to further strengthen the adhesion between first ply 20 and second ply 21 to preserve the integrity of venting corridor 41 formed therebetween. Alternatively, adhesive 35 may be applied to first side 32 of first ply 20.

Once first ply 20 and second ply 21 have been adhered together by sheet attachment means 35, they are configured into a substantially tube shaped body, as best shown in FIG. 6, by adhering the operably attached two plies of sheet material to itself at overlapped seam 50. Thus, in the depicted embodiment, first ply 20 becomes the outermost ply and second ply 21 becomes the innermost ply of vented container apparatus 10. However, as indicated above, Applicant's invention contemplates the use of more than two plies of sheet material in constructing vented container apparatus 10, with these additional plies being operably adhered to either of the depicted plies, as well as to each other, without departing from the scope of Applicant's invention.

As can be seen in FIG. 2, sheet attachment means 35 is not continuous over second ply 21. This discontinuity forms longitudinal void region 13*a* in sheet attachment means 35 along the entire length of plies 20 and 21. In the preferred embodiment of the invention, void region 13*a* is approximately three-eighths of an inch wide, however, this width is dependent on the overall size and capacity of vented container apparatus 10, the particle size of vapor and gas exuding articles 60, and the nature of the vapors and gases 61. The absence of sheet attachment means 35 in void region 13*a*, allows first ply 20 to remain independent of second ply 21 at the void region 13*a*, as shown in FIGS. 4 and 6, while the remainder of first ply 20 and second ply 21, as shown in FIG. 5, are operably adhered together; to remain in continuously attached contact.

The formation of void region 13*a* forms venting corridor means 41, between first ply 20 and second ply 21 after they are attached. Venting corridor means 41 is flanked on both sides by sheet attachment means 35, with corridor 41 bounded on its top by first side 32 of first ply 20 and on its bottom by second side 31 of second ply 21. Venting corridor means 41, along with first hole means 14 and second hole means 15 comprise venting means 13, which collectively communicates exuded vapors and gases 61 from interior region 40 to the exterior of apparatus 10.

As shown in FIG. 4, first hole means 14 comprises first opening side 36, which is positioned substantially proximate top 11 in first side 33 of innermost ply 21; second opening side 37 in second side 31 of second ply 21 and a venting pathway between first and second openings 36 and 37. First hole means 14 communicates exuded gases and vapors 61 away from interior region 40 to venting corridor means 41. Where apparatus 10 is constructed with more than one ply between interior region 40 and venting corridor means 41, first hole means 14 is nonetheless continuous from interior region 40 through to venting corridor means 41. Second hole means 15 comprises third opening 38, which is positioned substantially proximate to bottom 12 in first side 32 of first ply 20, fourth opening 39 in second side 30 of outermost ply 20, with a venting pathway extending between third and fourth openings 38 and 39.

Second hole means 15 formed thereby communicates exuded gases and vapors 61 out from venting corridor means 41 to the exterior of apparatus 10. Where apparatus 10 is constructed with more than one ply between venting corridor means 41 and the exterior, second hole means 15 is nonetheless continuous from venting corridor means 41 through to the exterior.

In the depicted embodiment, first and second hole means 14 and 15 are approximately one-eighth inch in diameter, however this diameter is clearly dependent on the particle size of vapor and gas exuding articles 60, as well as container capacity and nature of the vapors and gases. Where vapor and gas exuding articles 60 comprise whole roasted coffee beans, a one-eighth inch diameter has been found acceptable to provide sufficient venting, while preventing migration, of the coffee beans down venting corridor means 41. The smaller the particle size of vapor and gas exuding articles 60, the smaller the diameter of first and second hole means 14 and 15 and the smaller the width of venting corridor 41. Where first and second hole means 14 and 15 respectively continue through a number of plies of sheet material, the diameter of the hole means may vary without departing from the scope of Applicant's invention, as long as there remains sufficient hole and corridor widths for adequately venting interior region 40. In another embodiment of the invention, first and second hole means 14 and 15 may comprise a semicircular hole. In this embodiment, there may further be a flap created from the paper partially cut out in forming the semicircular hole. These flaps are deployed such that they are forced open by exuded vapors and gases 61 as those vapors and gases are communicated out of interior region 40 to the exterior.

Figure 6L:
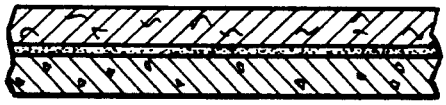

FIGS. 6A through 6L of the drawings show various material combinations that may be utilized in practicing Applicant's invention, including, but not limited to the following innermost/outermost layer combinations: paper/paper (FIG. 6A); paper/plastic (FIG. 6B); paper/foil (FIG. 6C); paper/porous paper (FIG. 6D); plastic/plastic (FIG. 6E); plastic/paper (FIG. 6F); plastic/foil (FIG. 6G); plastic/porous paper (FIG. 6H); foil/foil (FIG. 6I); foil/paper (FIG. 6J); foil/plastic (FIG. 6K); and foil/porous paper (FIG. 6L).

FIG. 7 is a cut-away perspective view of apparatus 10 having interior region 40 filled with vapor and gas exuding articles 60, which has been depicted as whole fresh-roasted coffee beans. As vapor and gas exuding articles 60 exude various vapors and gases 61, these vapors and gases 61 may otherwise pressurize interior region 40 which has been sealed, such that, without venting means 13, vented container apparatus 10 may be deformed and may eventually rupture without venting. As shown in FIG. 7, exuded vapor and gas 61 is vented through venting means 13. Exuded vapor and gas 61 enters into venting means 13 through first hole means 14 operably located proximate top 11 of apparatus 10 within second (innermost) ply 21. Exuded vapor and gas 61 travels through the first hole means 14 into venting corridor means 41.

Exuded vapor and gas 61 continues along venting corridor means 41 until it is communicated out of venting corridor means 41 towards the exterior of apparatus 10 by second hole means 15. Exuded vapor and gas 61 exits from vented corridor means 41 through second hole means 15 and out to the exterior. Second hole means 15 in first (outermost) ply 20 is located at a position substantially proximate bottom 12 of apparatus 10 so as to be distally spaced from first hole means 14 so as to prevent contamination and migration of articles 60 located within interior region 40. Thus, exuded vapor and gas 61 may escape from interior region 40 to the exterior of apparatus 10.

Where additional plies of sheet material are added, the first and second hole means 14 and 15 respectively will be continuous from the interior region 40 through to venting corridor means 41 and from venting corridor means 41 to the exterior of the outermost ply of apparatus 10. Thus, apparatus 10 is vented in a manner preventing contamination and migration, while preventing rupture. It should be further understood that the invention contemplates the use of a plurality of venting means, either through a plurality of holes in a single venting corridor, or through a plurality of venting corridors, to enhance venting while substantially preventing migration and contamination of vapor and gas exuding articles 60.

The foregoing description and drawings merely explain and illustrate the invention and the invention is not limited thereto except insofar as the appended claims are so limited and as those skilled in the art who have the disclosure before them will be able to make modifications and variations therein without departing from the scope of the invention.

What is claimed is:

1. A vented container apparatus for storing various vapor and gas exuding articles, said vented container apparatus being formed from a plurality of plies of sheet material configured to create a venting corridor therebetween, said vented container apparatus comprising:

at least two plies of sheet material, each of said at least two plies having a first side, a second side opposite said first side, a top edge, and a bottom edge opposite said top edge, wherein one of said at least two plies of sheet material is an innermost ply and another one of said at least two plies of sheet material is an outermost ply;

sheet attachment means for operably adhering at least portions of at least one of said at least two plies to at least another of said at least two plies;

a portion of said first side of said at least one of said at least two plies being operably adhered to said second side of said at least another of said at least two plies at a ply attachment region by said sheet attachment means;

said at least two plies being configured into a substantially tube shaped, folded container body having a longitudinal seam, said container body being sealable at said top and bottom edges to contain said articles therewithin an interior region formed between said top and bottom edges and enveloped by said innermost ply of sheet material;

venting means through which said exuded vapors and gases trapped within said interior region of said vented container are conducted to the exterior of said vented container apparatus;

said venting means exclusive of said longitudinal seam and including venting corridor means for transferring said vapor and gas between at least two of said at least two plies which are operably positioned at said ply attachment region so as to form therebetween a void flanked by said sheet attachment means, said void being bounded on its top by said first side of said at least one of said at least two plies, and on its bottom by said second side of said at least another of said at least two plies;

said venting means further including first hole means for communicating said exuded vapors and gases into said venting corridor means and away from said interior region, said first hole means having at least first and second openings, said first opening being operably located within said innermost ply at a position substantially proximate one of said top and bottom edges of said interior region and said second opening being operably connected to said venting corridor means and in operable alignment with said first opening; and said venting means further including second hole means for communicating said exuded vapors and gases out from said venting corridor means and toward said exterior of said vented container apparatus, said second hole means having at least a third and a fourth opening, said third opening being operably connected to said venting corridor means and located at a position substantially proximate the other one of said top and bottom edges of said vented container so as to be distally spaced from said second opening of said first hole means, said fourth opening in operable alignment with said third opening and operably located within said first side of said outermost ply which is located at said exterior of said vented container apparatus;

said venting means serving to conduct said vapor and gas from said venting corridor means and in turn from said interior region for release to said exterior of said vented container apparatus while preventing the contamination and migration of said articles located within said interior region.

2. The invention according to claim 1 wherein said substantially tube shaped, folded container body is configured as a substantially rectangularly shaped, flat bag, each of said at least two plies of sheet material therewithin having a first edge and a second edge opposite said first edge, each of said top and bottom edges being operably disposed between said first and second edges.

3. The invention according to claim 2 wherein said substantially rectangularly shaped, flat bag, has a longitudinal axis from said top edge to said bottom edge, said venting corridor means comprising a substantially rectangular shaped corridor operably disposed along said longitudinal axis;

said first hole means comprising a first hole between said interior region and said substantially rectangular shaped corridor;

said second hole means comprising a second hole between said shaped corridor and said exterior of said substantially rectangularly shaped, flat bag.

4. The invention according to claim 1 wherein said substantially tube shaped, folded container body is configured as a gussetted bag.

5. The invention according to claim 1 wherein said top and bottom edges comprise plain pinch type closures.

6. The invention according to claim 1 wherein said sheet attachment means comprises an adhesive material.

7. The invention according to claim 1 wherein said sheet attachment means comprises heat activated sealing means for attaching said portion of said first side of said at least one of said at least two plies to said second side of said at least another of said at least two plies, at said ply attachment region.

8. The invention according to claim 1 wherein said innermost ply of said at least two plies of sheet material comprises a substantially air and water impervious material.

9. The invention according to claim 1 wherein at least one of said at least two plies of sheet material comprises a paper sheet material.

10. The invention according to claim 9 wherein said outermost ply of sheet material comprises porous paper sheet material.

11. The invention according to claim 1 wherein at least one of said at least two plies of sheet material comprises a plastic sheet material.

12. The invention according to claim 1 wherein at least one of said at least two plies of sheet material comprises a foil sheet material.

* * * * *